US005221140A

United States Patent [19]

Oshino

[11] Patent Number: 5,221,140

[45] Date of Patent: Jun. 22, 1993

[54] MINIATURE LAMPS

[75] Inventor: Hiroshi Oshino, Tokyo, Japan

[73] Assignee: Oshino Electric Lamp Works, Ltd., Tokyo, Japan

[21] Appl. No.: 848,525

[22] Filed: Mar. 9, 1992

[30] Foreign Application Priority Data

Jul. 29, 1991 [JP] Japan ..... 3-059393[U]

[51] Int. Cl.[5] ..... F21V 17/04

[52] U.S. Cl. ..... 362/255; 362/293; 362/311; 313/318; 313/580; 313/635; 439/230; 439/605; 439/936

[58] Field of Search ..... 362/255, 293, 311, 457, 362/382, 226; 313/318, 312, 580, 635; 439/230, 276, 605, 936

[56] References Cited

U.S. PATENT DOCUMENTS 3,077,022 2/1963 Cullis, Jr. ..... 313/318
3,312,814 4/1967 Reading ..... 362/255
3,946,263 3/1976 Protzeller ..... 313/312
4,744,011 5/1988 Tomita et al. ..... 362/267
5,080,614 1/1992 Utgaren ..... 439/936

FOREIGN PATENT DOCUMENTS 0175333 3/1986 European Pat. Off. .
56-96441 8/1981 Japan .
8803327 5/1988 World Int. Prop. O. ..... 313/635

*Primary Examiner*—Ira S. Lazarus
*Assistant Examiner*—L. Heyman
*Attorney, Agent, or Firm*—Keck, Mahin & Cate

[57] ABSTRACT

A sub-miniature lamp in which a lamp body having a filament and an envelope is covered with a soft silicone rubber cap of a predetermined color having an opening at one end to a predetermined length of lead wires extending from the lamp body. A closure member is fitted to the opening of the envelope to seal the opening. The colored silicone rubber cap covers the envelope of the lamp body and is extended to a predetermined length of the lead wires, with the opened end of the cap fitted with an adhesive agent or a disc pad.

7 Claims, 2 Drawing Sheets

MINIATURE LAMPS

BACKGROUND OF THE INVENTION

The present invention relates in general to miniature lamps and more carticularly to very small colored indicator lamps which are called as "sub-miniature lamps" in the field of an incandescent lamp industry.

An incandescent lamp changes electrical energy to radiant energy. The light generated results from the filament being resistance heated to a temperature high enough to produce visible light.

Filaments cannot be operated in an oxygen atmosphere, so they must be vacuum sealed (or gas filled) in a glass bulb. The vacuum acts like an insulator and holds the heat at the filament.

The basic materials used in manufacturing sub-miniature lamps are soft lime glass, tungsten, molybdenum, and dumet. The soft glass is easy to work with and will tolerate temperatures up to 370 degrees Celsius. Dumet, a copper clad nickel iron core, is used for the lead wires and supports (electrodes) because it has the closest expansion and contraction rate to glass and offers an excellent hermetic seal. This seal is important in maintaining a high vacuum level which is critical in the overall reliability of lamps and to guarantee long life and MSCd (mean spherical candelas) stability.

In recent years, very small indicator lamps have been developed for use in instrument panels such as of aircraft, automobiles, etc. and for industrial uses. For instance, the trend is changing from simple miniature lamps to semiconductor indicator lamps using light-emitting diodes (LEDs) and very small indicator lamps which employ filaments. The mainstream is still the very small indicator lamps of the filament type that do not cause the brightness to change even during the day time. In the past, the colored indicator lamps used for the instrument panels were obtained by simply applying a paint to the surfaces of the lamp bodies that are the glass bulbs. With such a painting method, however, blending of the paints becomes so difficult that the color is not easily developed homogeneously and the depth of color differs depending upon the production lots. In these days, therefore, there has been proposed a colored indicator lamp 28, as shown in FIG. 10 obtained by covering a lamp body 28 having a glass envelope 21 a with a cap 23 made of a colored silicone rubber of which the color can be freely adjusted in the stage of the materials.

However, the conventional colored indicator lamp has defects as described below. That is, the base portion of the lamp body 28 has a bi-pin lamp structure to which is fitted a plastic base 25 that serves as a so-called base cap, and the lower end of the cap 23 surrounding the lamp body 28 from the top thereof is pulled down to the lower peripheral portion of the base 25. Therefore, the assembling operation becomes cumbersome, resulting in an increase in the number of assembling steps and requiring an increased number of parts. Moreover, since the base 25 is usually made of a white plastic, the light emitted from the lamp body partly leaks to the lower side and, hence, the amount of light passing through the silicone rubber cap may decrease correspondingly, and the color may change. Furthermore, the size increases due to the structure that the base is expose, and the cap 23 that covers up to the base portion results in an increase in the outer diameter correspondingly.

SUMMARY OF THE INVENTION

An object of the present invention is to provide an improvement in a very small colored indicator lamp, or sub-miniature lamp.

Another object of the present invention is to provide a new sub-miniature lamp which can eliminate a conventional base attached to the lower end of the lamp.

A further object of the present invention is to provide a new sub-miniature lamp which can decrease the assembly steps and the cost for production thereof.

Another object of the present invention is to provide a new sub-miniature lamp which can prevent leakage of light.

According to the present invention, there is provided a sub-miniature lamp in which a lamp body having a filament and an envelope is covered with a soft silicone rubber cap of a predetermined color having an opening at one end to a predetermined length of lead wires extending from the lamp body. A closure member, preferably of an adhesive agent of non light transmitting material, is fitted to the opening of the envelope to seal the opening.

In an embodiment of the present invention, a plurality of lamp bodies are connected to a plurality of legs of a lead frame and covered with soft silicone rubber caps.

In the present invention, the colored silicone rubber cap covers the envelope of the lamp body and is extended to a predetermined length of the lead wires, with the opened end of the cap fitted with an adhesive agent. The adhesive agent, which may be formed into a columnar or disc-like pad, serves as a base, the base being necessary in the convention structure, and the lower end is flat and permits stable seat on a flat board.

In the continuously arragned type of lamps in which the lead wires of lamp bodies are connected, in advance to the lead frame having a plurality of support pins, for connecting with the lead wires, the lamp bodies are enclosed in the colored silicone rubber caps in the same manner as described above, and the open end portions of the caps, through which the lead wires are extended, are closed by the adhesive agent.

PREFERRED EMBODIMENT OF THE INVENTION

Figure 1:
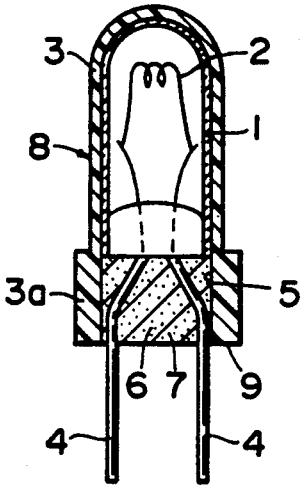
FIG. 1 is a sectional view of a sub-miniature lamp embodying the present invention.
Figure 2:
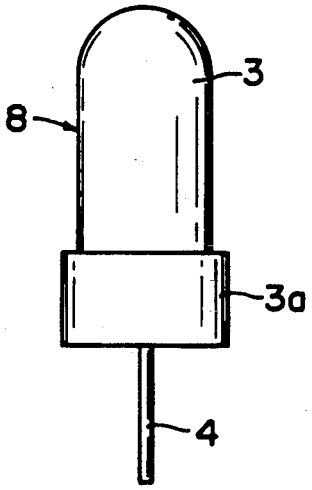
FIG. 2 is a side view of the lamp shown in FIG. 1.
Figure 3:
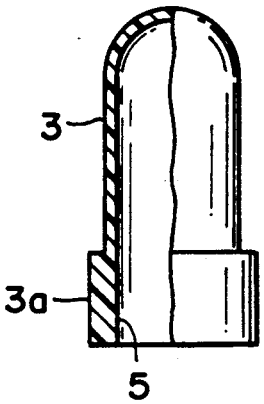
FIG. 3 is a partly cut out side view of a cap for the lamp envelope.

Referring first to FIGS. 1 through 4, a sub-miniature lamp body 1 is obtained by machining a transparent tube, preferably of glass, having a predetermined diameter to form an envelope and by disposing a filament 2 therein. An outer peripheral surface of the lamp body 1 is closely covered with, and enclosed in, a soft and sack-like colored silicone rubber cap 3, which the applicant calls as a "rubber foot", of which any chromaticity and color tone can be freely changed by blending the colored starting materials. The rubber caps 3 an opening at one end and the opened lower end portion is extended to a position so that it covers a predetermined length of the lead wires 4 which extend from the lamp body 1 through the opening. A space 5 formed in the lower portion of the cap 3 and in the lower portion of the lamp body 1 is filled with an adhesive agent 6 which is then cured to form a cylindrical (columnar) pad 7. The distance between the lead wires 4 are preadjusted to a specified length for use.

Figure 10:
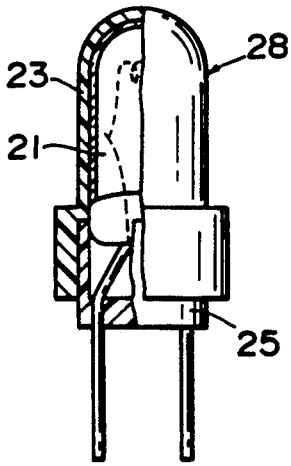
FIG. 10 (PRIOR ART)
FIG. 10 is a partly sectional side view of a conventional lamp.

In forming the colored lamp 8, the lamp body 1, which is formed with a transparent envelope and filaments, is forcibly covered with a thin colored silicone rubber cap 3 by the use of the elasticity of the rubber cap 3. The rubber cap 3 has an inner diameter slightly smaller, by about 0.1 mm, than the outer diameter of the lamp body 1 so as to be closely and resiliently attached thereto. The rubber cap 3 is simply pulled downwardly from the top of the lamp body 1. A slightly thick, stepped portion 3*a* is formed at the open end of the cap 3 for the purpose of withstanding the pulling force and for serving as a conventional base frame (26 in FIG. 10). Then, the adhesive agent 6 is supplied into the space 5 at the lower inside portion of the cap 3. The adhesive agent is cured with the portions of the lead wires 4 including therein, and becomes flush with the end of the cap 3 so that the completed colored indicator lamp has an entirely flat surface 9 at its bottom.

Figure 4:
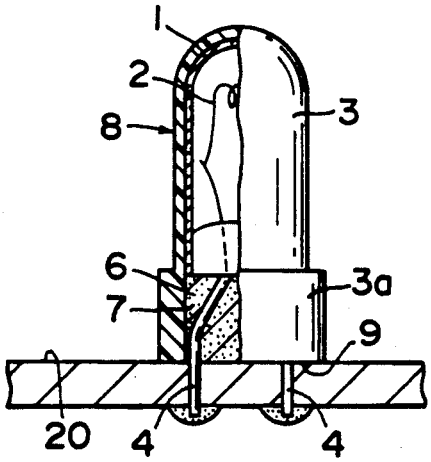
FIG. 4 is a partly sectional side view of the lamp adapted to a substrate in use.

As shown in FIG. 4, the colored lamp 8 is placed on a substrate 20, such as a printed circuit board, the flat bottom surface 9 enhances a stable mounting for assembly. The lead wires 4 pass through holes bored in the substrate 20 and are suitably soldered at the back. The lamp 8 as a whole may have the length of the cap 3. Unlike the conventional lamp shown in FIG. 10, in which the cap is fitted to the base 25 (FIG. 10) that is previously fitted to the lamp body, the outer diameter can be determined by the diameter of the cap in the present invention and, hence, a lamp of a smaller size is realized. Further, since a pad 7 of the adhesive agent 6 is disposed on the bottom opening or space 5 of the lamp body 1, the light of the lamp does not leak downwardly through the space 5 and the predetermined brightness of the predetermined color is obtained by the lamp. That is, the light that passes through the cap 3 from the lamp body 1 has a brightness of a predetermined color tone.

Figure 5:
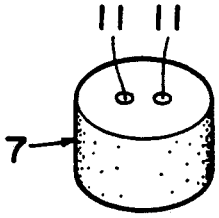
FIG. 5 is a perspective view of a pad of an adhesive agent adaptable to an open end of the cap.

The pad 7 may be disc shaped as shown in FIG. 5 having a diameter as that of the lamp body 1. The pad 7 is made of a material that does not permit the transmission of light, and provided with holes in advance for inserting therethrough the lead wires 4. The holes are extended angularly for preventing light leakage. The pad is adhesively fitted to the lower end of the lamp body with a suitable adhesive agent. The pad 7 thus formed in advance enhances the stable seating on the substrate and prevents the leakage of light as similar as in the previous embodiment explained with reference to FIGS. 1–4.

Figure 6:
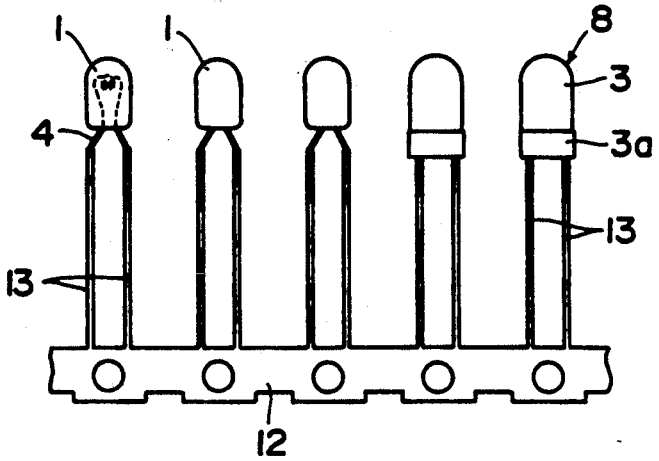
FIG. 6 is a side view of the lamp in another embodiment of the invention, showing a use of a lead frame.
Figure 7:
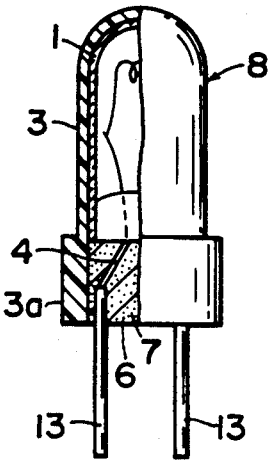
FIG. 7 is a partly sectional view of the lamp in accordance with the embodiment of FIG. 6.

With reference to FIGS. 6 and 7 showing another embodiment of the present invention, a lead frame 12 is used and a plurality of lamps are connected by welding the lead wires 4 of the lamp bodies 1 to the upper ends of support pins 13 that form pairs of thick lead wires on one side of the lead frame 12. The lamp bodies 1 are closely covered with a colored silicone rubber cap 3 in a manner that the support pins 13 are partly covered in the same manner as the previous embodiment, the adhesive agent 6 is supplied into the space 5 at the lower portion of the cap 3 and cured to obtain a colored indicator lamp 8 in the same manner as described above. The adhesive agent 6 is supplied in such an amount that the lower portion of the cap 3 is flat. In the use of this type of lamp, the base portions of a pair of support pins 13 are cut from the lead frame 12; i.e., a single colored indicator lamp 8 is obtained. That is, if the support pins 13 that are the legs of the colored indicator lamp 8 are inserted in the board 20, the bottom of the colored indicator lamp 8 which has a flat surface 9 by the pad 7 of the adhesive agent 6 can be seated stably on the board 20. Moreover, since the pad 7 of the adhesive agent 6 is disposed in the bottom of the colored indicator lamp 8, the light does not leak downwardly and brightness having predetermined color tone and luminous intensity is obtained.

Figure 8:
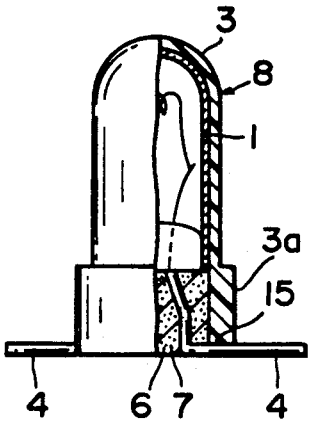
FIG. 8 is a partly sectional view of a lamp according to another embodiment of the invetnion.
Figure 9:
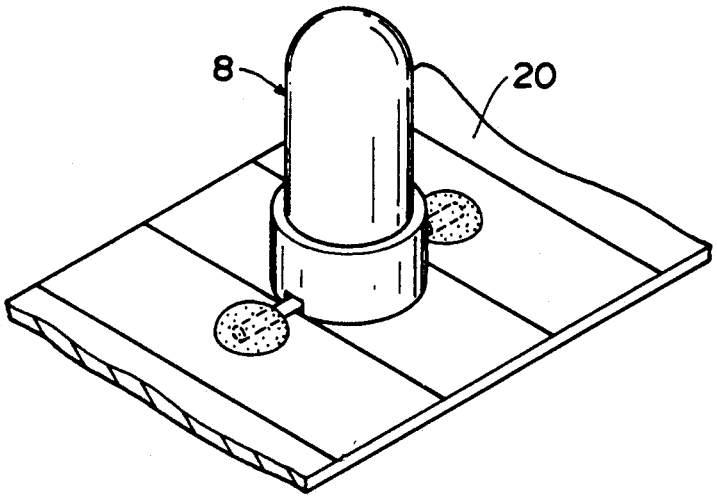
FIG. 9 is a perspective view of the lamp shown in FIG. 8 showing the lamp fitted on a printed circuit board.

With reference to FIGS. 8 and 9, showing a further embodiment of the invention, the colored silicone cap 3 has openings 15 at the lower end portion for passing therethrough the lead wires 4, so that the lead wires 4 can be extended outwardly and horizontally as illustrated. This configuration allows a stable positioning of the lamp for weldering the lead wires to the predetermined position of a patterned printed circuit board 20 (PCB).

According to the present invention, the lamp body is covered with a colored silicone rubber cap which extends to envelope the lead wires partly and, then, an adhesive agent or pre-formed pad is fitted to the space within the lower portion of the lamp. Unlike the conventional lamps, therefore, there is no need of providing a base or a base cap in the lower portion of the lamp body. Thus, the number of parts and he number of assembling steps can be decreased, enabling the cost to be reduced. Moreover, since the lower end of the cap has a flat surface, the lamp can be stably mounted on the board (PCB) even though it does not have a base. Furthermore, since the bottom portion is sealed with a pad such as of the adhesive agent or the like, there is no leakage of light, and predetermined color tone and luminous intensity are obtained. The silicone rubber cap covering the lamp body permits the color to be freely adjusted, and the color is obtained stably. Further, the pad of the adhesive agent can change the distance between the lead wires.

What is claimed is:

1. A miniature colored map comprising:

a lamp body having a transparent envelope with an opening at one end thereof and a filament in said envelope, lead wires connected to ends of said filament and extended outwardly from said opening of said envelope, a colored cap of an elastic material having an opening at one end thereof, said cap having an inner diameter slightly smaller than an outer diameter of said transparent envelope of said lamp body, said cap being resiliently extended over an outer surface of said envelope to thereby cover said envelope, and said cap having a thickened, stepped portion at an open end thereof for covering a lower outer portion of said lamp body and for withstanding pulling force, said thickened portion forming a base for supporting said lamp, and a closure member fitted to a lower inner portion of said opening of said cap to seal the open end of said cap with said lead wires being extended therethrough.

2. The miniature colored lamp according to claim 1, wherein said cap is made of silicone rubber.

3. The miniature colored lamp according to claim 1, wherein said closure member is cured adhesive agent.

4. The miniature colored lamp according to claim 1, wherein said closure member is a pre-formed pad of a disc shape.

5. The miniature colored lamp according to claim 1, wherein said closure member has two holes extending angularly so that said lead wires are extended therethrough for an external connection.

6. The miniature colored lamp according to claim 1, wherein the lead wires are formed of a lead frame by providing pins extending from one side of said lead frame.

7. A method for producing a miniature colored lamp comprising the steps of:

covering a lamp body with a thin, colored silicone rubber cap by stretching said rubber cap to cover said lamp body;

said rubber cap having a thickened portion at an open end thereof;

supplying an adhesive material in a space formed at the lower inside portion of said cap;

curing said adhesive material to form a plug therein;

forming a flat surface of said cured material flush with a lower edge of said thickened portion of said cap, thereby forming an enlarged flat surface, whereby said enlarged flat surface forms a stable mounting for the lamp assembly.

* * * * *